US007469673B2

(12) United States Patent
Wagner

(10) Patent No.: US 7,469,673 B2
(45) Date of Patent: Dec. 30, 2008

(54) ROTARY-PISTON ENGINE AND VEHICLE COMPRISING AN ENGINE OF THIS TYPE

(75) Inventor: Arnold Wagner, Winterthur (CH)

(73) Assignee: Peraves AG, Winterthur (CH)

( * ) Notice: Subject to any disclaimer, the term of this patent is extended or adjusted under 35 U.S.C. 154(b) by 69 days.

(21) Appl. No.: 10/599,669

(22) PCT Filed: Apr. 6, 2005

(86) PCT No.: PCT/CH2005/000198

§ 371 (c)(1),
(2), (4) Date: Oct. 5, 2006

(87) PCT Pub. No.: WO2005/098202

PCT Pub. Date: Oct. 20, 2005

(65) Prior Publication Data

US 2007/0209632 A1 Sep. 13, 2007

(30) Foreign Application Priority Data

Apr. 6, 2004 (CH) ..... 0595/04

(51) Int. Cl.
*F02B 33/44* (2006.01)
*F01C 3/06* (2006.01)

(52) U.S. Cl. ..... 123/241; 123/245; 123/18 R; 418/68

(58) Field of Classification Search ..... 123/241, 123/245, 18 R; 418/68, 53, 35–38; *F01C 3/02, F01C 3/06, 9/00; F02B 33/44*
See application file for complete search history.

(56) References Cited

U.S. PATENT DOCUMENTS 1,904,373 A * 4/1933 Kempthorne ..... 418/68
1,967,167 A * 7/1934 Weis ..... 418/68
2,043,544 A * 6/1936 Kempthorne ..... 123/241
2,069,646 A * 2/1937 Cohen ..... 123/241
2,501,998 A * 3/1950 Dutrey ..... 418/68
2,808,006 A * 10/1957 Paulsmeier et al. ..... 418/68
3,075,506 A * 1/1963 Berry ..... 123/43 B
3,229,677 A * 1/1966 Hughes ..... 123/43 B
3,549,286 A * 12/1970 Moriarty ..... 418/85

(Continued)

FOREIGN PATENT DOCUMENTS

DE 296 363 C 2/1917

(Continued)

*Primary Examiner*—Thai-Ba Trieu
(74) *Attorney, Agent, or Firm*—Pearne & Gordon LLP

(57) ABSTRACT

A rotary-piston engine includes at least two rotary pistons, which are located in an essentially spherical housing and which rotate in common about a rotational axis running through the center of the housing, each of the rotary pistons comprising two pistons that are interconnected in a fixed manner, lie diametrically opposite the center of the housing and execute pivoting displacements back and forth in opposite directions about a pivoting axis running perpendicular to the rotational axis, during their rotation. To control the pivoting displacements, the engine is provided with loose spherical or ellipsoidal rotational bodies, which are rotatably mounted in the sliding surfaces of the pistons in respective guide sockets that are hemispherical or ellipsoidal and which engage in at least one guide groove that is configured in the housing. The groove has an essentially hemispherical or ellipsoidal profile.

15 Claims, 11 Drawing Sheets

U.S. PATENT DOCUMENTS

| | | | | | |
|---|---|---|---|---|---|
| 3,994,640 | A * | 11/1976 | Cohen | 418/68 |
| 4,024,841 | A * | 5/1977 | Smith | 123/241 |
| 5,147,193 | A * | 9/1992 | Larsen | 418/68 |
| 5,199,864 | A * | 4/1993 | Stecklein | 418/68 |
| 6,579,081 | B1 * | 6/2003 | Kuznetsov | 418/68 |
| 7,214,045 | B2 * | 5/2007 | Turner | 418/68 |
| 7,258,082 | B2 * | 8/2007 | Huettlin | 123/241 |
| 2005/0008515 | A1 * | 1/2005 | Huttlin | 417/481 |

FOREIGN PATENT DOCUMENTS

| | | | |
|---|---|---|---|
| DE | 25 39 084 | A1 | 3/1977 |
| DE | 2811051 | A1 * | 9/1979 |
| DE | 102005026661 | A1 * | 12/2006 |
| DE | 102006009197 | A1 * | 8/2007 |
| DE | 102006009198 | A1 * | 8/2007 |
| GB | 2115490 | A * | 9/1983 |
| WO | 03 067033 | A1 | 8/2003 |
| WO | 2004/014716 | A1 | 2/2004 |
| WO | WO 2007090314 | A1 * | 8/2007 |

* cited by examiner

ROTARY-PISTON ENGINE AND VEHICLE COMPRISING AN ENGINE OF THIS TYPE

BACKGROUND OF THE INVENTION

The invention relates to a rotary-piston engine comprising at least two two-armed rotary pistons, which are located in an essentially spherical housing and which rotate in common about a rotational axis running through the center of said housing. Each of the rotary pistons comprises two pistons in the form of piston arms that are interconnected in a fixed manner, lie essentially diametrically opposite to each other with respect to the center of the housing and execute pivoting displacements back and forth in opposite directions about a pivoting axis running perpendicular to the rotational axis, during their rotation, whereby guide members are embodied on at least two pistons, which engage in at least one guide groove embodied in the housing for controlling the pivoting displacements.

Furthermore, the invention pertains to a vehicle with such a rotary-piston engine.

Rotary piston-engines belong to the category of combustion engines, where the operating cycles of embedding, compressing, expanding, and emitting of the combustion gas mixture is effected according to the four-stroke Otto or diesel method with externally-supplied ignition or self-ignition by means of pivoting movements of the pistons between two end positions.

A rotary piston-engine of the above-mentioned type known from WO 03/067033 A1 comprises two rotary pistons rotating in a housing which is spherical on the inside, the rotary pistons each being supported on a journal forming the pivoting axis via a bearing ring being connected with their pistons and sealed against the housing. The journal is fixedly connected with a shaft, which forms the rotational axis. The pistons of the rotary pistons located opposite to one another each have a sliding surface facing towards the housing, an operating side with an operating surface, and a backside facing away therefrom, whereby two operating sides of two adjacent pistons facing one another define an operating chamber together with the housing, and the backsides of two adjacent pistons define an antechamber together with the housing, the antechamber increasing or decreasing in volume in opposite direction to the operating chambers.

The back and forth pivoting movements of the pistons are bilaterally guided in a groove arranged on the inside of the spherical housing by means of guide members, the guide members being described as piston-solid roller journals or slide bearings. The geometry of this groove acting as a control cam has the shape of a circle constricted on diametrically opposite sides. This roller journal or slide-bearing guide positioned in the piston has the disadvantage that, due to the tangential orientation of the guide members, two staggered rollers are necessary so that during a change of the guide force onto the opposite side, a grinding does not take place on the groove, caused by the reversal of the unrolling direction of rotation. A slide bearing, in turn, causes high friction and thus reduced efficiency and high wear and tear on this most important part of the engine kinematics, which replaces the crankshaft of the lifting cylinder motor.

A further disadvantage of this guide configuration is seen in that the roller journals are mounted on the piston backsides, protruding beyond them, and that the guide grooves at the housing side, which work as antechamber walls for a pre-compression, are not covered against the piston backsides. The pre-compression is thus considerably reduced by this fluidic dead space. Furthermore, the lubricating fluid necessary for the lubrication of the rollers and guide grooves can reach through overflow channels into the operating chamber partly as leakage fluid and can lead to a high consumption of lubricating fluid as well as to two-stroke-like blue-smoke in the exhaust gas, whereby it is difficult to fulfill today's motor vehicle exhaust gas standards and it becomes difficult or impossible to use the rotary-piston engine several times.

With the known rotary-piston engine, a perfect mass equilibrium as well as moment distribution is achieved by the symmetrical piston movements. However, because the pivoting movements of the piston halves are three-dimensional movements, equalized masses and moments are not sufficient here for a quiet run, contrary to lifting cylinder and/or rotary engines. The piston and guide member masses dislodge and approach the rotational axis in a 90° cycle. Related thereto are rotary mass changes leading to free Coriolis forces, which cause corresponding torque fluctuations on the rotational axis. Due to the fact that the torque fluctuations are additionally in phase therewith by means of operating cycle and compression, an extensive damping of these torsional vibrations, for example by means of torsional vibration dampers in the output, high gyrating masses and/or a second engine coupled to the rotational shaft phase-shifted at 90° , as well as all-around elastomer suspension, must take place for a quiet engine run.

In the known rotary-piston engine, the pivoting of the pistons takes place such that, during a 360° rotation about the rotational axis, the 4 cycles of the suction, compression, expansion, and discharge result for both operating chambers being defined between the pistons. Thus, a self-ignition or externally supplied ignition thus takes place every 180° . Furthermore, the two antechambers formed by the piston backsides are used for pre-compression of the fresh mixture (gas) and for charging the operating chambers, whereby one respective operating chamber is charged by both antechambers. For controlling this gas exchange, a relatively complex valve configuration is provided, which comprises check valves for controlling during suction into the antechambers and either a magnetic valve, which controls bypasses located outside of the housing, or check valves in the piston walls with a direct pass from the antechambers into the operating chambers.

The spherical motor housing yields the largest room content at a minimal outer surface. This means that with an air or fluid cooling of the outer surfaces, in comparison with a lifting cylinder or rotary engine, a considerably smaller amount of cooling surface must be available for a corresponding engine output. In particular, when using the high power spectrum made possible by the geometry of the sphere, an interior cooling must therefore additionally be present. With the known rotary-piston engine, it is provided to essentially ensure this interior cooling with the fresh mixture, which cools the antechamber side of the pistons and is to be preheated thereby. It is considered disadvantageous that a preheating of the fresh mixture can lead to power loss and knocking problems and is only suitable for a small power density.

SUMMARY OF THE INVENTION

The invention is based on the object of creating a rotary-piston engine of the above-mentioned type, which is improved particularly with reference to construction costs, operating characteristics, and wear and tear, in a simple construction, which does not have the above-mentioned disadvantages.

To begin with, this object is solved according to the invention with respect to the above-mentioned rotary-piston engine in that the guide members are embodied as loose, spherical rotational bodies, in that the at least two pistons are each embodied with an essentially hemispherical guide pan for receiving one half of one of the rotational bodies, and in that the guide groove at the housing side is embodied with an essentially semi-circular profile.

A second solution of this object is achieved, according to the invention with respect to the above-mentioned rotary-piston engine in that the guide members are embodied as loose, ellipsoidal rotational bodies, in that the at least two pistons are each embodied with an essentially semi-ellipsoidal guide pan for receiving one half of one of the rotational bodies, and in that the guide groove at the housing side is embodied with an essentially semi-elliptical profile.

On the basis of the embodiment of the guide pans and of the guide groove according to the invention, a compact construction of the rotary-piston engine is achieved and a constructively simple guide configuration is created for the pistons, which combines the advantages of the low friction of a complex double-roller guide with the simplicity of a slide bearing guide and thus ensures a guiding of the pistons which is low in wear and tear.

With the embodiment according to the second solution of the object, the housing, in comparison with the embodiment with spherical guide members, can be embodied with a more narrow guide groove, which enables greater piston pivoting and thus the formation of chamber volumes which can be utilized to a greater extent, under the same material strain and with the same housing size.

Further developments of the invention result from the dependent claims.

Further advantages and features result from the following description and the enclosed drawings.

It is understood that the above-mentioned features, which will be explained below, cannot only be used as indicated, but also in other combinations or by themselves, without leaving the scope of the present invention.

BRIEF DESCRIPTION OF THE DRAWINGS

Subsequently, the invention will be explained by means of the enclosed drawings. It is shown.

DETAILED DESCRIPTION OF THE EXAMPLE EMBODIMENTS

Figure 1:
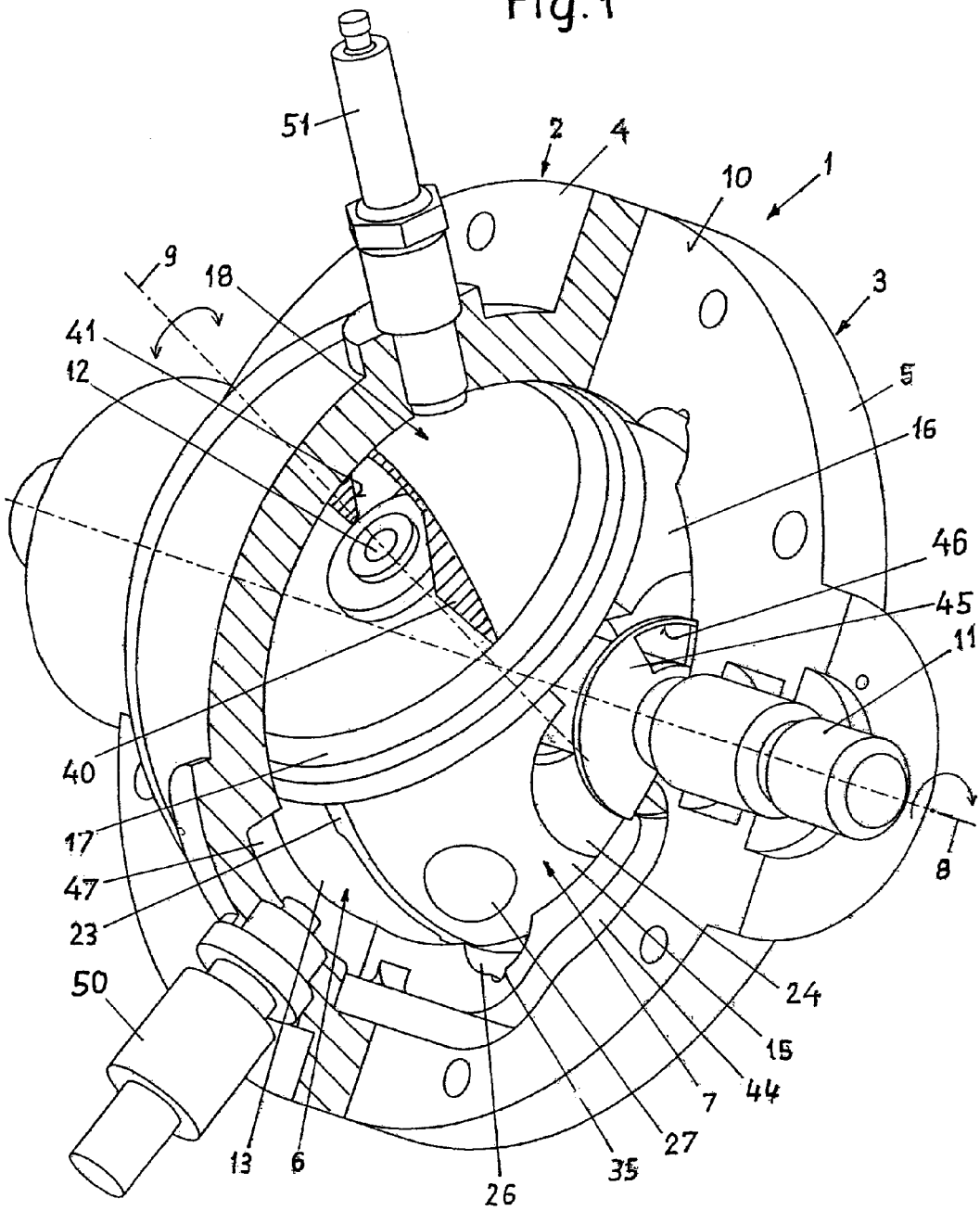
FIG. 1 a partial cut, perspective general view of a first embodiment of a rotary-piston engine according to the invention, FIG. 2 a perspective exploded illustration of components of the interior engine of the rotary-piston engine according to FIG. 1, FIG. 3 a perspective view of a housing half of the rotary-piston engine according to FIG. 1, FIG. 4 a two-armed rotary piston of the rotary-piston engine according to FIG. 1 in a side view and a partial section according to line IV-IV in FIG. 5, FIG. 5 a two-armed rotary piston of a second embodiment of the rotary-piston engine according to the invention in a front view and a partial section according to line V-V in FIG. 4, FIG. 6 a section through the rotary-piston engine according to FIG. 1 in a plane according to the partial section of the housing in FIG. 1, FIG. 7 a section through the rotary-piston engine according to FIG. 1, according to line VII-VII in FIG. 6, FIG. 8 a section through the rotary-piston engine according to FIG. 1, according to line VIII-VIII in FIG. 6, with pivoted rotary pistons each pivoted in a corresponding medium pivoting position FIG. 9 a section through the rotary-piston engine according to FIG. 1, according to line IX-IX in FIG. 6 with rotary pistons each pivoted in the corresponding end position, FIG. 10 a section through the rotary-piston engine according to FIG. 1, according to line X-X in FIG. 6, and FIG. 11 a road vehicle with a rotary-piston engine according to the invention as drive motor.
Figure 2:
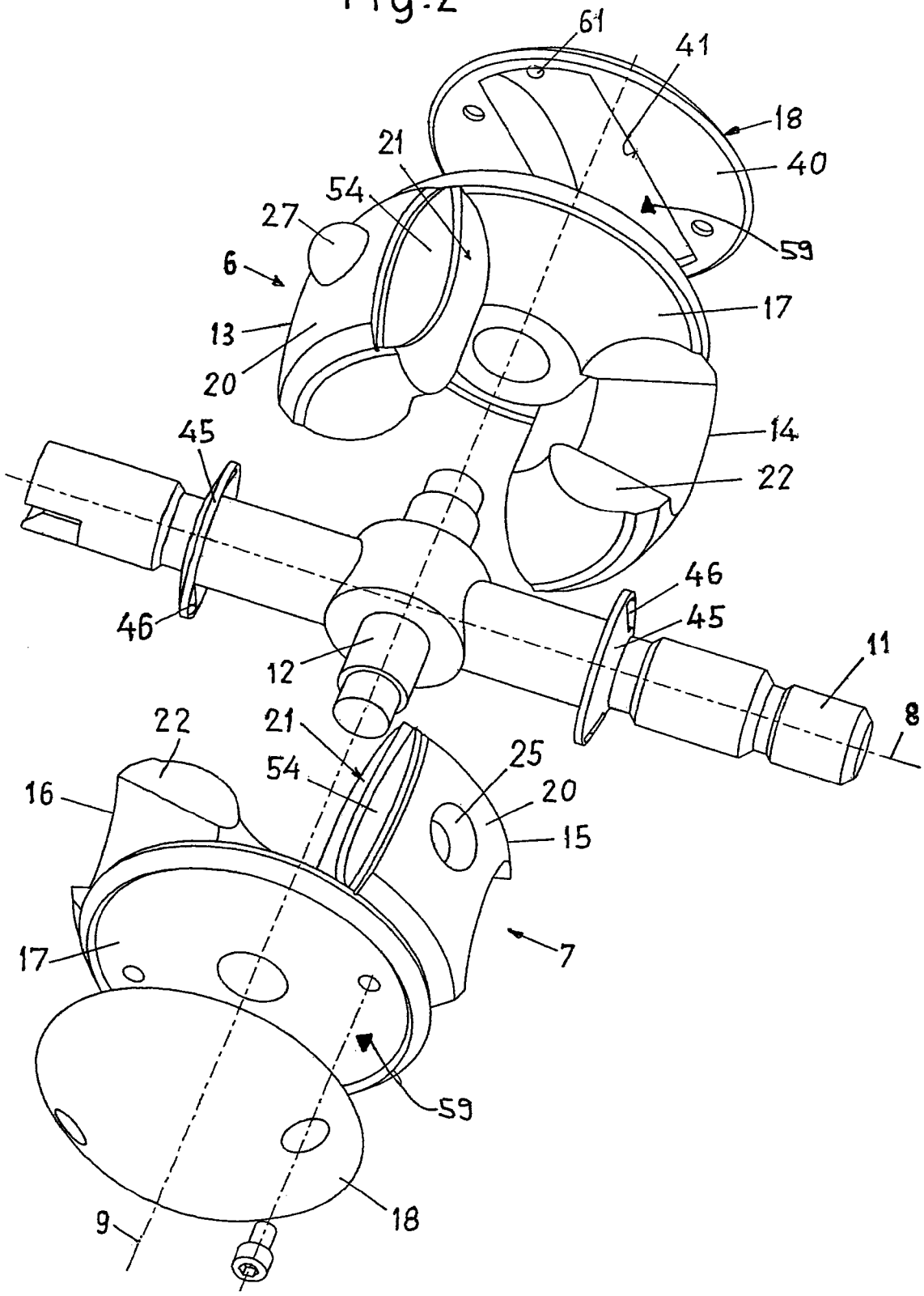

The rotary-piston engine according to FIG. 1, which is illustrated as a motor with externally-supplied ignition, has an essentially spherical housing 1 with spherical inner surface, which is divided by a junction plane 10 into two housing halves 2 and 3, which are connected with one another via a ring flange 4 or 5 and non-illustrated screws. In the housing 1, two two-armed rotary pistons 6 and 7 are located, which together rotate about a rotational axis 8 arranged at the center of the housing and thereby execute pivoting displacements back and forth in opposite directions overlapping the rotational movement about a pivoting axis 9 running perpendicular to the rotational axis 8. The rotational axis 8 is formed by a shaft 11, which is supported on both sides in the housing 1 and which is embodied as a pinion shaft.

The rotary pistons 6 and 7 each have two pistons 13 and 14, or 15 and 16, respectively, located essentially diametrically opposite to one another in the form of piston arms, which are fixedly interconnected with one another and with a wall part 17, which can be sealed against the inner wall of the housing 1, and are supported at the ends of a journal 12 that is fixedly connected with the shaft 11 and forms the pivoting axis 9. The wall parts 17 are each provided with a spherical cap 18 adapted to the form of the inner wall. The pistons 13, 14, and 15, 16 of the rotary pistons 6 or 7, respectively, located opposite to one another, each have a sliding surface 20 facing the housing, an operating side with an operating surface 21 extending essentially radially with reference to the pivoting axis 9, and a backside 22 facing away therefrom, whereby two operating surfaces 21 facing one another, of two adjacent pistons 13 and 15, or 14 and 16, respectively, define an operating chamber 23 together with the housing 1, and the backsides 22 facing one another, of two adjacent pistons 13 and 15, or 14 and 16, respectively, define an antechamber 24 increasing or decreasing in volume in opposite direction to the operating chambers 23.

Guide members, which engage in at least one guide groove 26 embodied in the housing 1 and provided for controlling the pivoting movement of the rotary pistons 6 and 7, are arranged in the sliding surfaces 20 of the pistons 13-16. In the embodiment illustrated in FIGS. 1-4 and 6-9, the guide members are embodied as loose, spherical rotational bodies 27, whereby the pistons 13-16 are each embodied with an essentially hemispherical guide pan 25 for receiving one half of one of the rotational bodies 27 and the guide groove 26 at the housing side is embodied with an essentially semicircular profile.

Figure 5:
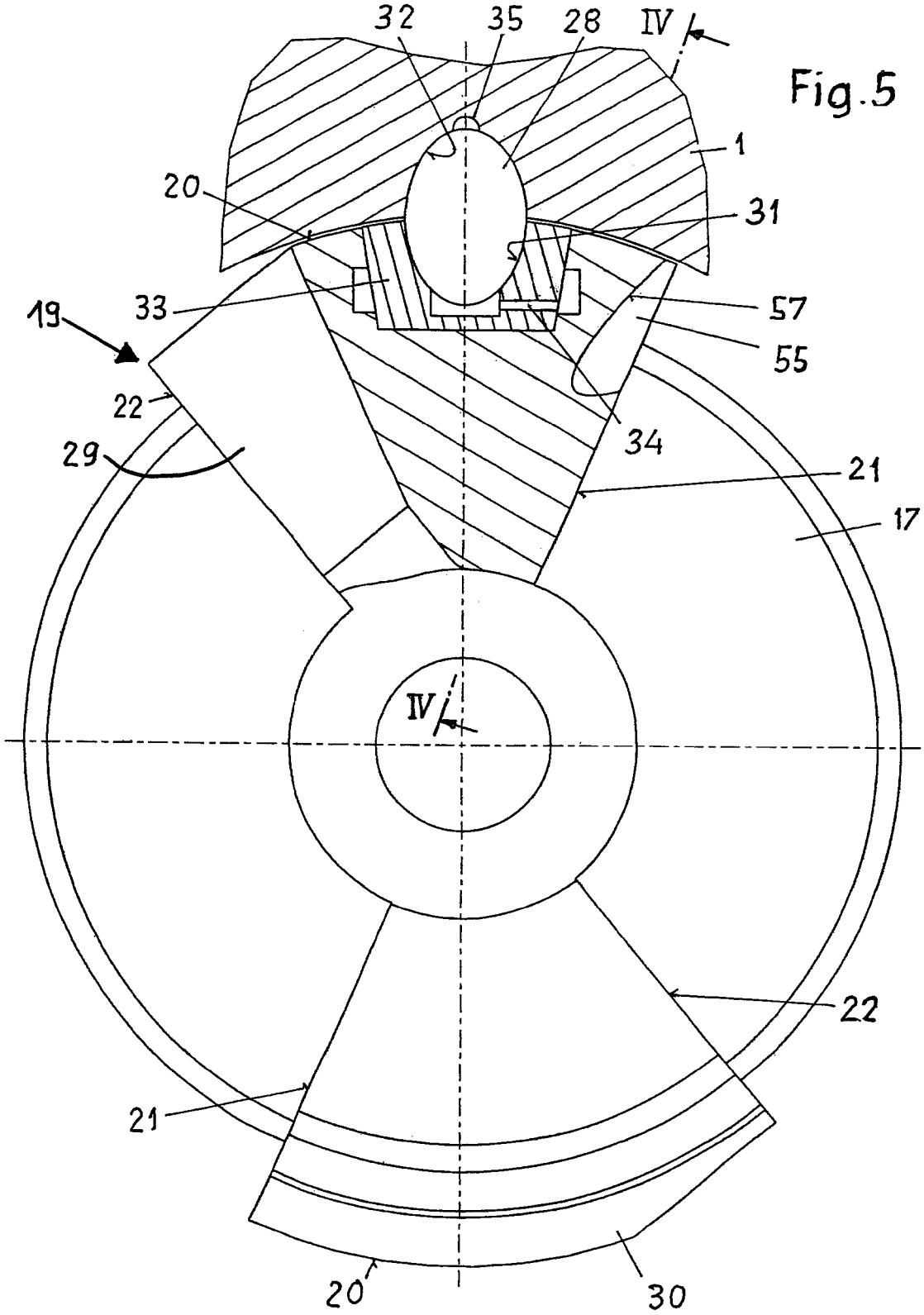

According to FIG. 5, a two-armed rotary piston 19 provided for the second embodiment of the rotary-piston engine according to the invention is embodied with pistons 29 and 30, each being provided with an essentially semi-ellipsoidal guide pan 31 for receiving one half of a loose, ellipsoidal rotational body 28. A guide groove 32 assigned to the rotational bodies 28 is accordingly embodied with an essentially semi-elliptical profile.

According to the illustration, each of the guide pans 31 can be embodied in a bearing part 33 being rotatably mounted in the piston 30 about a radial axis being perpendicular to the pivoting axis, whereby the rotational bodies 28 can follow the curves of the guide groove 32 without being clamped. Accordingly, a power transmission with advantageously low Hertzian stress between the rotational bodies 28 and the guide groove 32 can be achieved. This embodiment is suitable in an advantageous manner, in particular for high-performance embodiments of the rotary-piston engine according to the invention.

The guide pans 25 or 31, respectively, are each connected to a supply channel for a pressurized lubricating fluid embodied in the respective piston 13-16 or 29, 30, respectively, via a bore 34, which discharges into its base region. At the same time, during the lubrication of the guide members, a hydraulic compensation for play between the guide pans and the guide groove 26 or 32 can thereby be achieved , so that the formation of chatter marks and pitting can be prevented, friction can be reduced, and the efficiency of the rotary-piston engine can thus be increased.

Each of the guide grooves 26 or 32, respectively, located at the housing side are embodied with an additional smaller groove 35, which deepens the base region of its profile and which is provided for discharging the lubricating fluid and which is in connection with at least one discharge opening 36 for the lubricating fluid provided in the housing 1. A lubricating fluid accumulation can thus be prevented in front of the circulating guide members and the drainage of the lubricating fluid into an assigned container 37 can be expedited.

Figure 3:
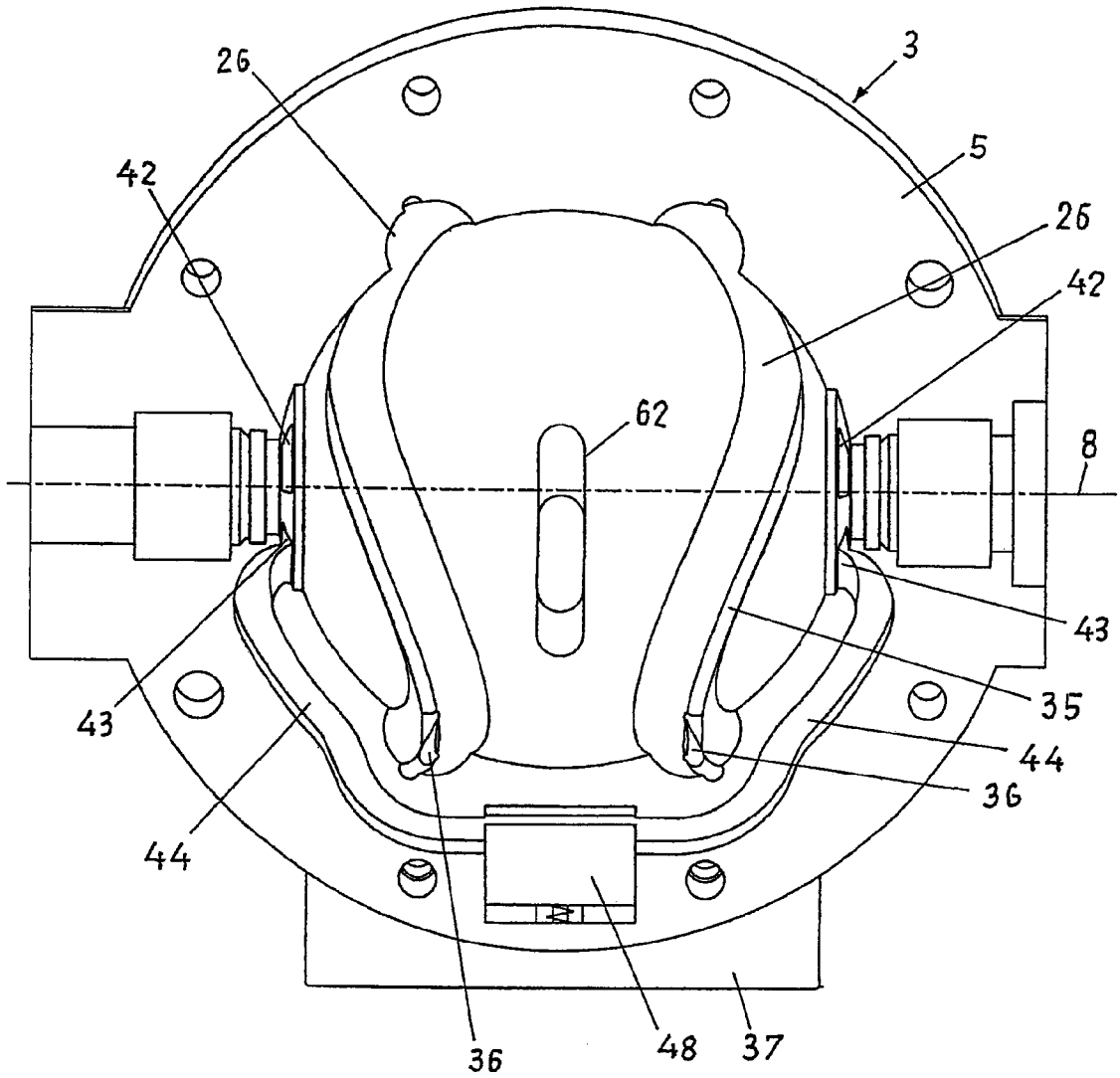
Figure 4:
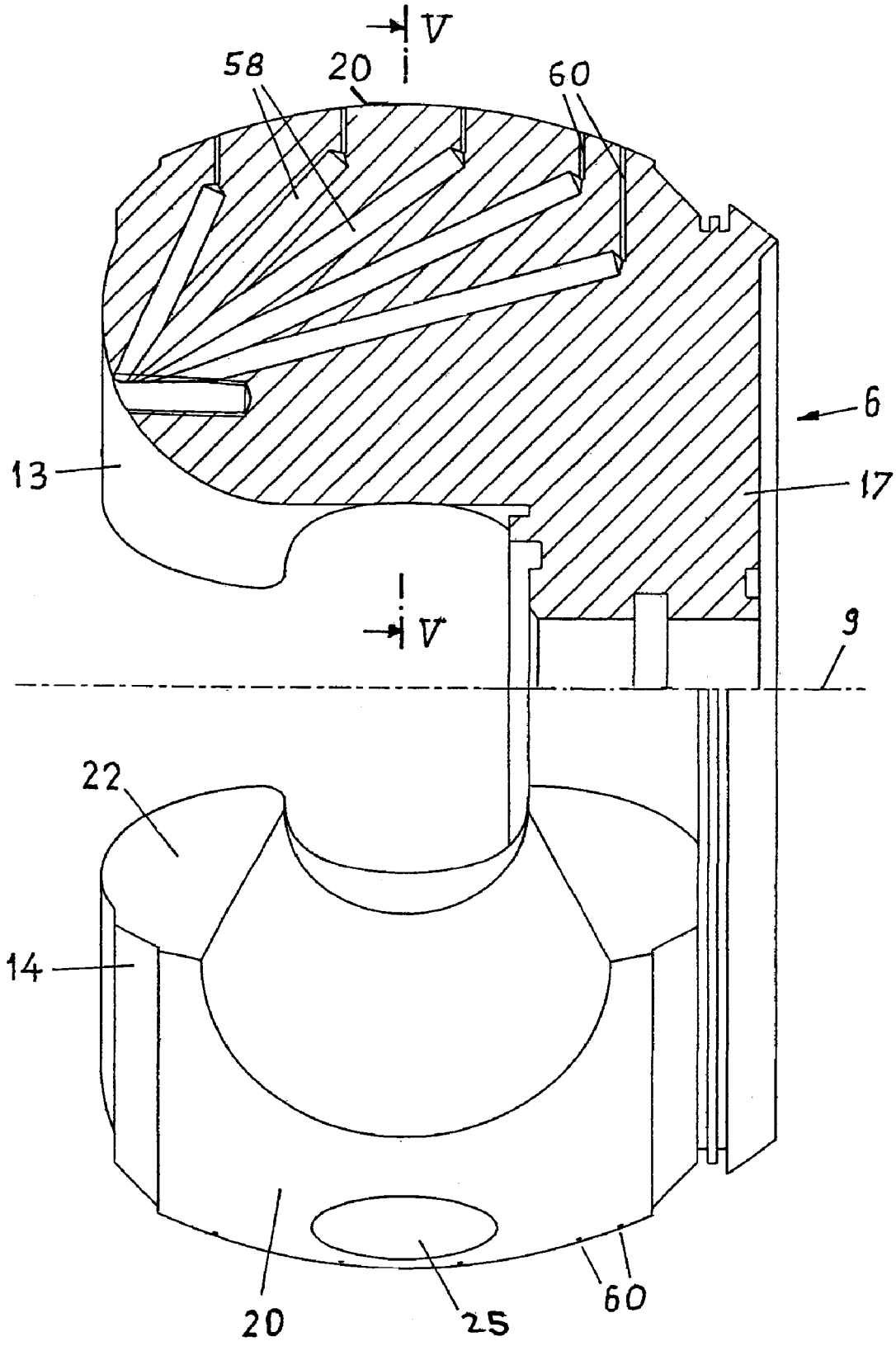

Contrary to the control cam known from the above-mentioned rotary-piston engine embodied in the form of a circle constricted on diametrically opposite sides, the control cam formed by the guide grooves 26 or 32, respectively, located at the housing side, is designed for the pivoting of the pistons by sine or cosine functions, whereby a 180° rotation of the rotational axis defines a cycle duration, and the pivoting angle of the pistons defines the amplitude. The advantage of this embodiment is seen in that a jolt-free rotation of the guide members in the guide grooves, in particular in the transitions at maxima, minima, as well as at the turn-over locations of the respective control cam, can be achieved (FIG. 3).

In the region of their sliding surfaces 20, the pistons 13-16 or 29, 30, respectively, are embodied with a width dimension corresponding to a complete coverage of the assigned guide grooves 26 or 32, respectively, located at the housing side and extending across the pivot region of the respective piston. It can thus be permanently covered and sealed against the operating chambers 23, as well as against the antechambers 24. In doing so, it is not only possible to achieve a high pre-compression up to 1 bar overpressure, but the leakage fluid portion can also be reduced to values of today's lifting cylinder motors, regardless of sufficient lubrication of the circulating guide members.

The rotary pistons 6 and 7 are each connected with a balance body 40 illustrated as a two-part body located inside of the housing 1, to equalize free Coriolis forces caused by rotary mass changes during the pivoting of the pistons 13, 16, or 29, 30, respectively, rotating around the rotational axis 8 and of the guide members 27 or 28, respectively. As can be seen from FIGS. 1 and 2, each of the balance bodies 40 embodied with a central recess 41 are integrated in the spherical cap 18. The balance bodies 40, preferably consisting of a heavy metal, such as tungsten, are screwed together with the rotary pistons 6 and 7 and arranged with respect to the pivoting axis 9 such that the balance bodies 40 are inclined with respect to the plane defined by the guide members 27 or 28 at an angle, so that the masses of the balance bodies 40 at least partially compensate changes of the torques caused by the approach or dislodgement of the pistons and guide members to or from the rotational axis 8, respectively, by means of a relative countermovement with respect to the rotational axis 8. In doing so, a predeterminable, partial or complete balance, or even an over-balance of the torque change can be achieved, alternatively depending on the dimensioning of the balance bodies. An over-balance by very large counter-masses has a dampening effect on the irregularity of the power torque of the engine, so that an advantageously quiet engine run can be achieved. Furthermore, large counter-masses have the advantage that further flywheel masses outside of the housing become unnecessary.

Figure 6:
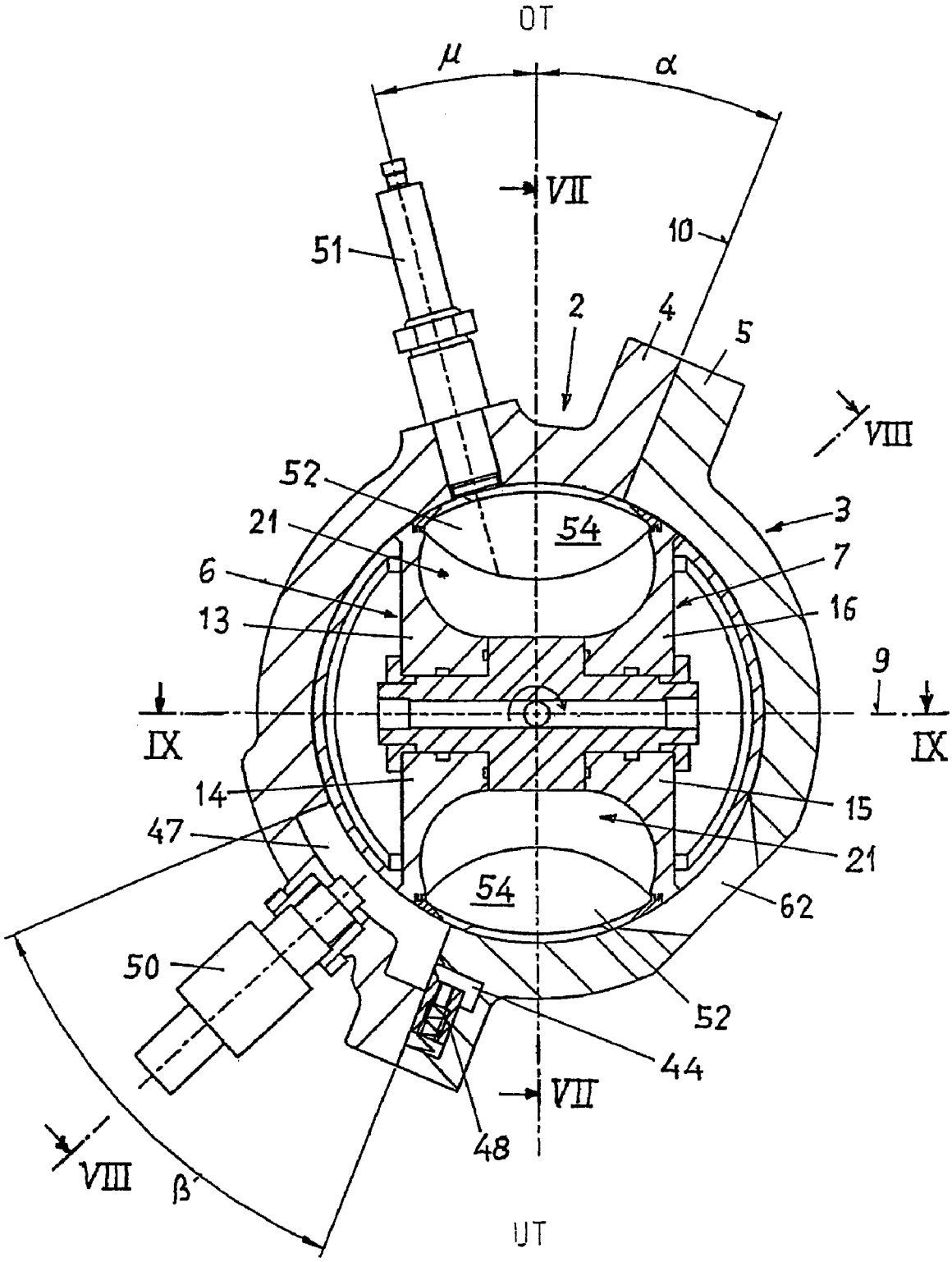
Figure 7:
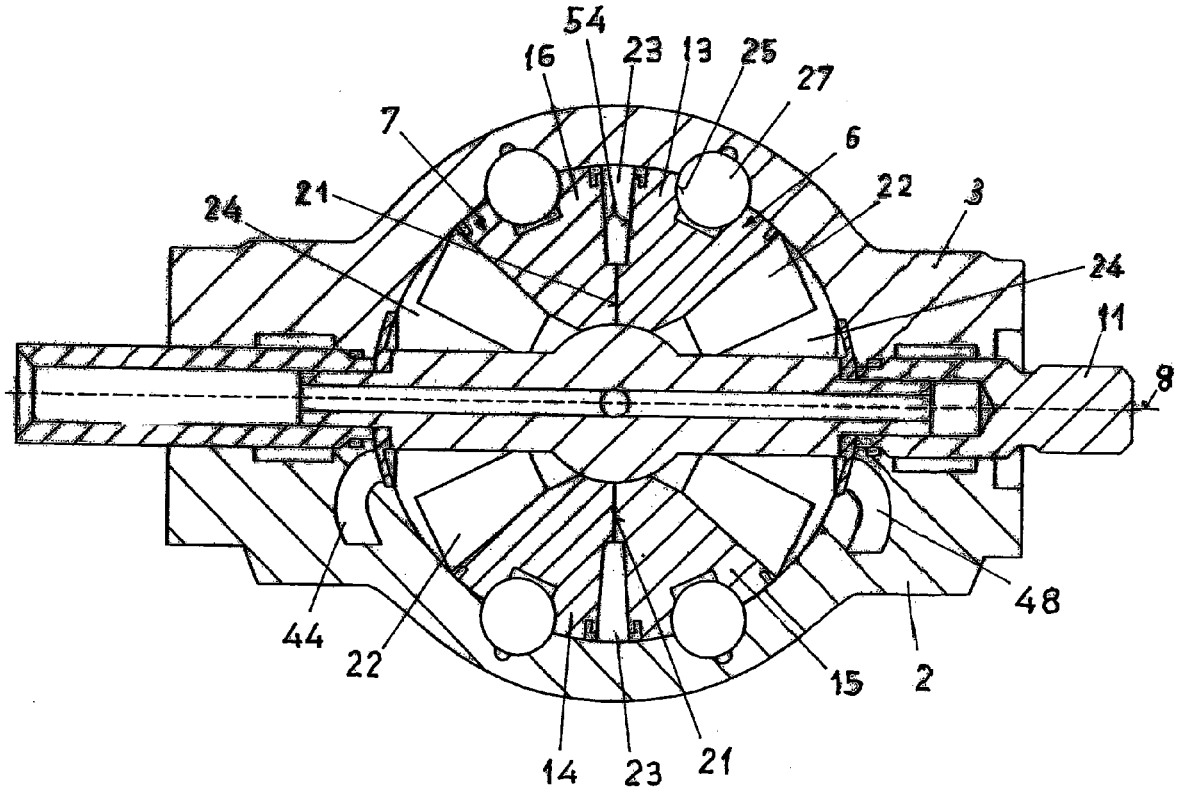
Figure 8:
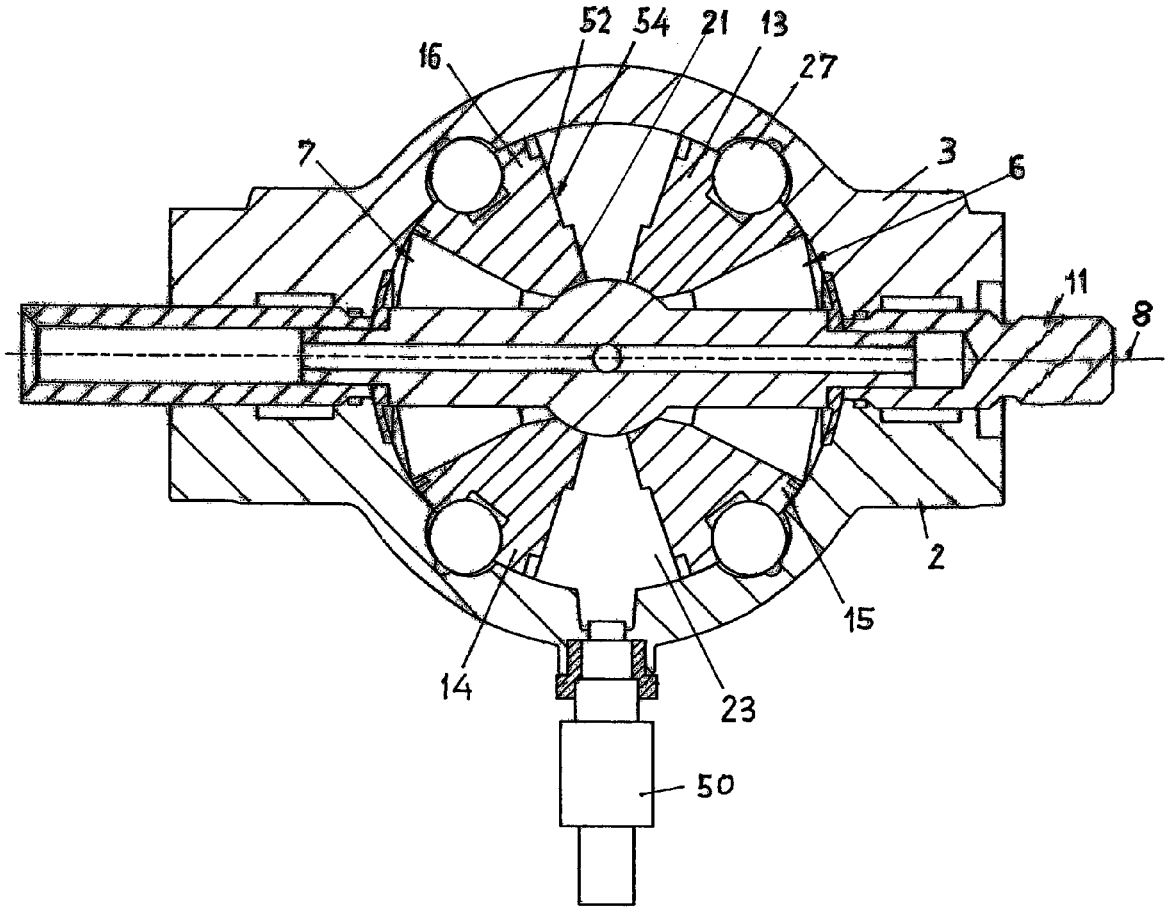
Figure 9:
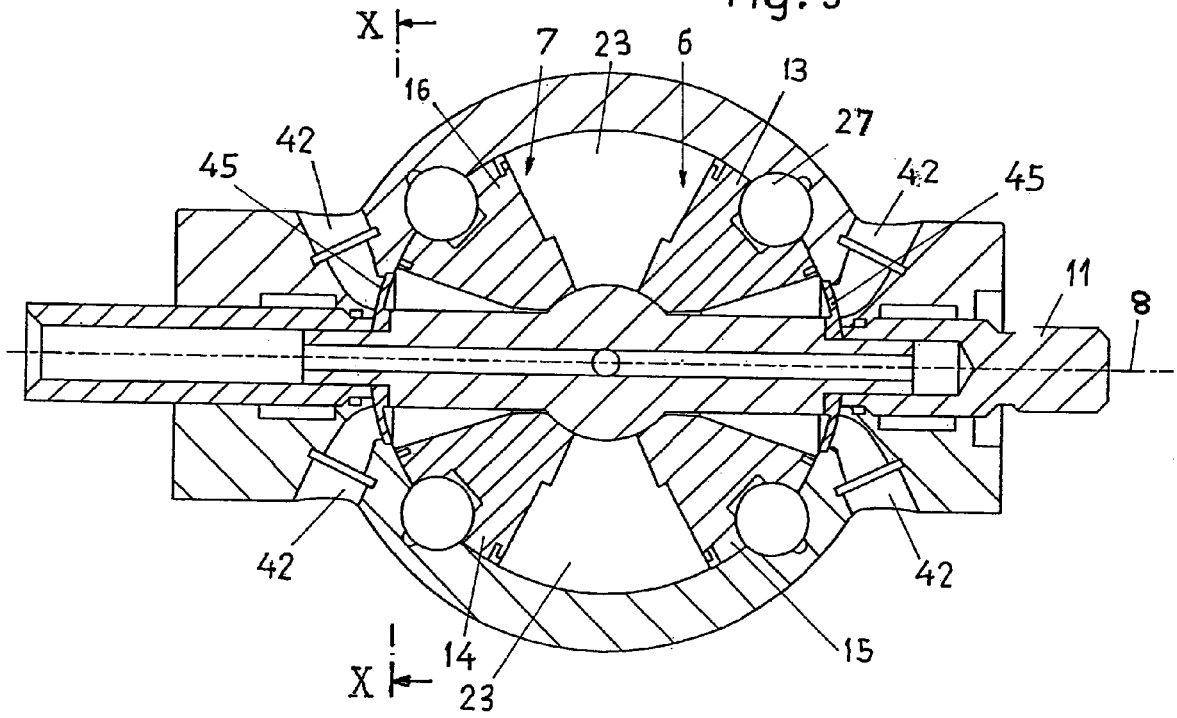
Figure 10:
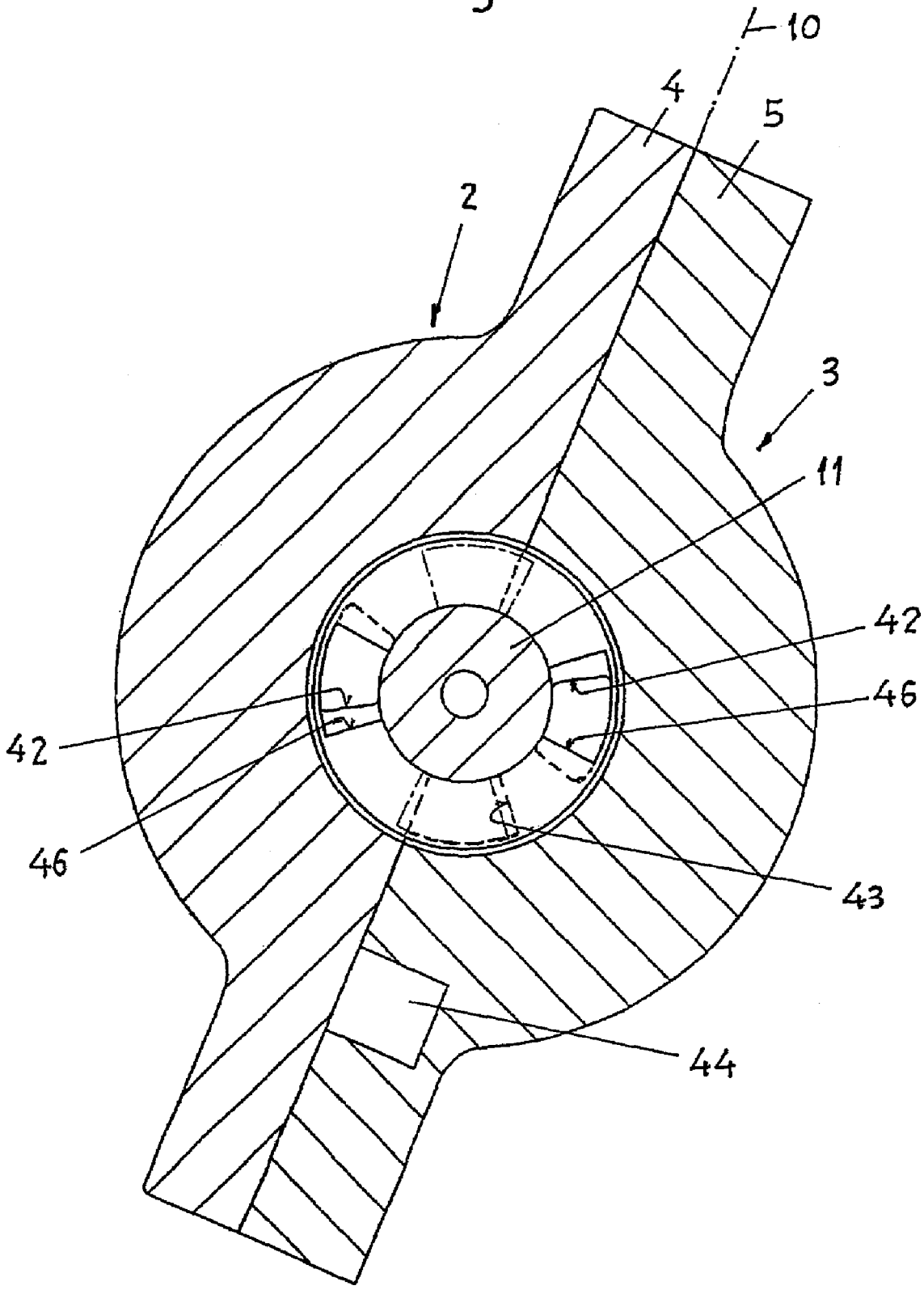

In the wall sections receiving the bearings of the shaft 11, the housing 1 is embodied with two suction openings 42 located opposite to one another relative to the rotational axis 8 designed for flooding the antechambers 24 with atmospheric fresh mixture and with one connection opening 43 displaced relative thereto, of an overflow channel 44 embodied in the housing for flooding the operating chambers 23 with pre-compressed fresh mixture. The shaft 11 is provided with two rotary slide valves 45, being insertable into the housing and being assigned to a respective one of the wall sections, each having two opposite windows 46, which can be brought together with the suction openings 42 as well as with the connection opening 43, whereby, during a 180° rotation of the shaft 11, all four windows 46 alternately release the suction openings 42, and two of the windows 46 release the connection openings 43 of the overflow channels 44. The advantage of this embodiment is the simple, cost-efficient construction of the control device effecting the alternate flooding, with which the gas exchange can be controlled directly and without the use of valves.

can particularly be seen from FIG. 6, the housing 1 is embodied such that the junction plane 10 extending through the rotational axis 8 is inclined at an angle $\alpha$ in the magnitude of between 15-30°, from the upper dead center OT corresponding to the maximum compression in rotational direction of the shaft 11. An advantage of this embodiment is that it enables an optimal configuration of the suction openings 42 assigned to the antechambers 24 with reference to the upper dead center location, independent on the housing division and that the overflow channels 44 can be incorporated into the junction plane of one of the housing halves, according to the illustration in the lower housing half 3, and be combined in a section thereof in the center. A central control groove 47, which can be connected to the center section of the overflow channels 44 for regulating the flooding of the operating chamber 23, is embodied in the inner wall of one of the housing parts, according to the illustration in the upper housing half 2. The length dimension thereof extends over a peripheral angle $\beta$ of the inner wall in the magnitude of 30-60° and the cross-section thereof essentially corresponds to twice the cross-section of one of the overflow channels 44. The advantage of this embodiment is that it enables a constant flooding of the operating chambers 23 during a period, which can be predetermined by the geometry of the control groove 47.

In the illustrated embodiment of the rotary-piston engine as externally supplied ignition engine, a throttle organ 48, a flat slide valve according to the illustration, is assigned to the center section of the overflow channels 44. An injection valve 50 for the fuel is mounted in the wall section of the housing 1 defining the control groove 47 and directed towards the respectively opening operating chambers 23. At least one sparkplug 51 is located in the center of the wall section of the housing 1, surrounding the pivoting region of the pistons 13-16, the sparkplug 51 being displaced from the upper dead center OT opposite to the rotational direction of the shaft 11 at a pre-ignition angle $\mu$, from which equal burning distances in or opposite to the rotational direction in the operating chambers 23 result, when the engine is at maximum output. The advantages of this embodiment are the configuration of the sparkplug 51, which can be achieved therewith and optimized in consideration of the burnout delay, and the short and cost-efficient, valve resistance-free flow routes, which can also be achieved. High performance as well as a good cold-start behavior and a direct power control can be achieved therewith.

With an embodiment as a self-ignition engine, at least one injection nozzle for injecting the fuel can be mounted in the center of the wall section of the housing 1, surrounding the pivoting region of the pistons 13-16, the injection nozzle being displaced from the upper dead center OT opposite to the rotational direction of the shaft 11 at a pre-ignition angle, from which equal burning distances in or opposite to the rotational direction in the operating chambers 23 result, when the engine is at maximum output. The advantage of this embodiment is the configuration of the injection nozzle, which can be achieved therewith and optimized in consideration of the burnout delay.

Each of the pistons 13-16 and 29, 23 are embodied with a bag-shaped recess 54 or 55, respectively, forming a swirl chamber, arranged in an end section, according to the illustration approximately in the upper half, of the operating surface 21, the end section being close to the housing, whereby the recesses 54 of the pistons 13-16 of the externally-supplied ignition engine are each embodied with a base surface 52 extending at least approximately radially relative to the pivoting axis 9, while the recesses 55 of the pistons 29, 30 of the self-ignition engine are each embodied with one base surface 57 converging towards the end of the operating surface 21 located close to the housing, which, according to the illustration, defines a semi-heart-shaped cavity. The advantage of these recesses is that, due to the turbulence of the fresh mixture, which can be achieved therewith, a knocking is prevented in the externally-supplied ignition engine or a higher performance can be achieved in the self-ignition engine with better combustion behavior due to the turbulence of the fresh mixture.

Each of the pistons 13-16 or 29, 30, respectively, are embodied with a plurality of cooling channels 58, which can be flooded with lubricating fluid from the rotational axis 8 and which are arranged behind the respective operating surface in the wall sections containing the operating surfaces 21. The cooling channels 58 are in connection with the discharge opening 36 for the lubricating fluid embodied in the lower housing half 3 via the passage bores 60 arranged in the sliding surface 20 of the respective piston 13-16 or 29, 30. Each of the wall parts 17 of the rotary pistons 6, 7 or 19, respectively, are embodied with at least one cooling section 59 being accordingly floodable with lubricating fluid and facing the spherical cap 18. The cooling section 59 is in connection with the discharge opening 36 assigned to the lubricating fluid container 37 via at least one passage bore 61 provided in the spherical cap 18. The advantage of this embodiment is that an overheating of the inner engine can be prevented by the direct cooling of the wall parts defining the operating chambers 23 and that the heat can be discharged with the lubricating fluid in a simple manner.

The exhaust gases of the combustion are discharged through an exhaust pipe slit 62 embodied in the lower housing half 3, the dimensioning of which determines the gas exchange control.

Figure 11:
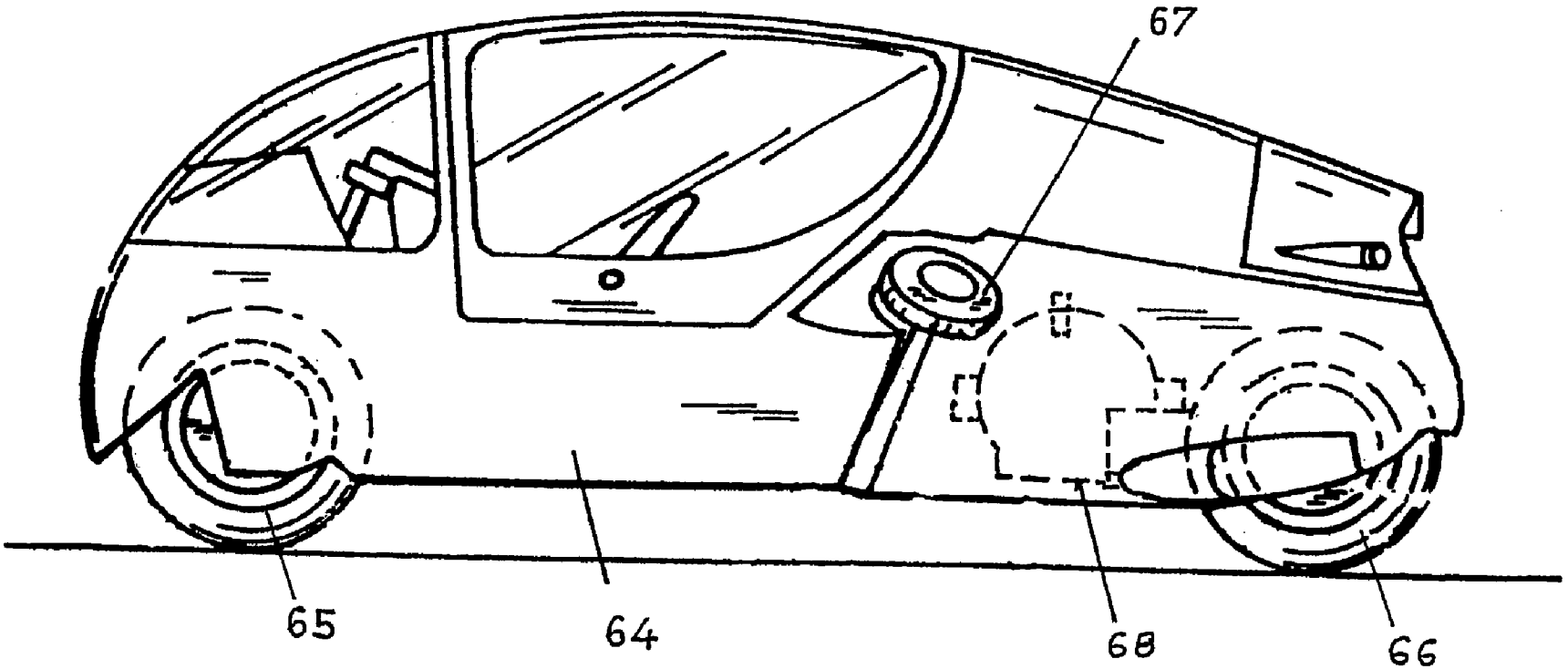

The road vehicle according to FIG. 11 has a body 64, a front wheel 65, a back wheel 66, and a stabilizing device 67 in the form of support rollers, which can be pulled upwards. A rotary-piston engine embodied according to the invention is provided as drive motor 68.

The invention claimed is:

1. A rotary-piston engine with at least two two-armed rotary pistons (6, 7; 19) being located in an essentially spherical housing (1) and rotating in common about a rotational axis (8) running through the center of the housing, each rotary piston comprising two pistons (13-16; 29, 30) in the form of piston arms being interconnected in a fixed manner and lying essentially diametrically opposite to each other with respect to the center of the housing and, during their rotation, the rotary pistons executing pivoting displacements back and forth in opposite directions about a pivoting axis (9) running perpendicular to the rotational axis (8), whereby guide members engaging into at least one guide groove (26; 32) designed in the housing (1) for controlling the pivoting movements are mounted on at least two pistons (13-16; 29, 30), characterized in that the guide members are embodied as loose rotational bodies (27, 28), in that each of the at least two pistons (13-16) are embodied with a guide pan (25, 31) for receiving one half of one of the rotational bodies (27, 28) and in that the respective guide pan (25; 31) is connected to a supply channel for a pressurized lubricating fluid embodied in the piston (13-16; 29, 30) via a bore (34) discharging into its base region, whereby either the rotational bodies (27) are embodied in a spherical manner, the respective guide pan (25) is embodied in an essentially hemispherical manner, and the guide groove (26) is embodied with an essentially semi-circular profile, or the rotational bodies (28) are embodied in an ellipsoidal manner, the respective guide pan (31) is embodied in an essentially semi-ellipsoidal manner, and the guide groove (32) is embodied with an essentially semi-elliptical profile.

2. The rotary-piston engine according to claim 1, characterized in that each of the guide pans (31) are embodied in a bearing part (33) being rotatably mounted in the piston (29, 30) about a radial axis being perpendicular to the pivoting axis (9).

3. The rotary-piston engine according to claim 1, characterized in that the guide groove (26; 32) is embodied with an additional groove (35) deepening the base region of its profile, being defined for discharging the lubricating fluid and being in connection with at least one discharge opening (36) provided in the housing (1) for the lubricating fluid.

4. The rotary-piston engine according to claim 1, the pistons (13-16; 29, 30) of which each comprise a sliding surface (20) facing the housing, an operating side with an operating surface (21), and a backside (22) facing away therefrom, whereby two operating sides facing one another of two adjacent pistons (13-16; 29, 30) define an operating chamber (23) together with the housing (1), and the backsides (22) of two adjacent pistons (13-16; 29, 30) facing one another define an antechamber (24) with the housing (1), characterized in that in the region of their sliding surfaces (20) each of the pistons (13-16; 29, 30) are embodied with a width dimension corresponding to a complete coverage of the assigned guide grooves (26; 32) located at the housing side and extending across the pivoting region of the respective piston (13-16; 29, 30).

5. The rotary-piston engine according to claim 4, whereby each of the rotary pistons (6, 7; 19) are connected with a wall part (17) being sealable against the inner wall of the housing (1), the wall part (17) being positioned on a journal (12) forming the pivoting axis (9) and being provided with a spherical cap (18) adapted to the form of the inner wall, characterized in that the pistons (13-16; 29, 30) are embodied with a plurality of cooling channels (58), which can be flooded with lubricating fluid from the rotational axis (8) and which are arranged behind the respective operating surface (21) in the wall sections containing the operating surfaces (21), the cooling channels (58) being in connection with the at least one discharge opening (36) embodied in the housing (1) for the lubricating fluid via the passage bores (60) arranged in the sliding surface (20) of the respective piston (13-16; 29, 30), and in that each of the wall parts (17) are embodied with at least one cooling section (59) being accordingly floodable with lubricating fluid, the cooling section (59) being in connection with the at least one discharge opening (36) via a passage bore (61) provided in the spherical cap (18).

6. The rotary-piston engine according to one of the preceding claims, characterized in that the control cam for pivoting the pistons (13-16; 29, 30) formed by the guide groove (26; 32) located at the housing side is determined by sine or cosine functions, whereby a 180° rotation of the rotational axis (8) defines a cycle duration, and the pivoting angle of the pistons (13-16; 20, 30) defines the amplitude.

7. The rotary-piston engine according to claim 1, characterized in that every rotary piston (6, 7) is connected with at least one balance body (40) located in the housing (1) and being dedicated for compensating the changes of the torques caused during the pivoting of the rotary pistons (6, 7) and of the guide members (27; 28) rotating about the rotational axis (8), whereby the balance body (40) is held in a position relative to the respective rotary piston (6, 7) and the pivoting axis (9), in which the mass of the balance body (40) fully or partially compensates for the changes of the torques relative to the rotational axis (8) caused by the pivoting movement of the respective rotary piston (6, 7).

8. The rotary-piston engine according to claim 1, whereby the rotational axis (8) is formed by a shaft (11) being supported on both sides in the housing (1), characterized in that the housing (1) in the wall sections surrounding the shaft (11) is embodied with two suction openings (42) located opposite to one another relative to the rotational axis (8) designed for flooding the antechambers (24) with atmospheric fresh mixture and with one connection opening (43) displaced relative thereto, of an overflow channel (44) embodied in the housing (1) for flooding the operating chambers (23) with pre-compressed fresh mixture and in that the shaft (11) is provided with two rotary slide valves (45), being insertable into the housing (1) and being assigned to a respective one of the wall sections, each having two opposite windows (46), which can be brought together with the suction openings (42) and the connection opening (43), whereby, during a 180° rotation of the shaft (11), all four windows (46) alternately release the suction openings (42), and two of the windows (46) release the connection openings (43) of the overflow channels (44).

9. The rotary-piston engine according to claim 1, whereby the spherical housing (1) is divided in a junction plane (10) extending through the rotational axis (8) into two housing halves (2, 3), characterized in that the junction plane (10) is inclined at an angle ($\alpha$) in the magnitude of 15-30° with respect to the upper dead center (OT) corresponding to the maximum compression in rotational direction of the rotational axis (8).

10. The rotary-piston engine according to claim 9, characterized in that the overflow channels (44) are incorporated into the junction plane of one of the housing halves (2, 3) and combined in a section thereof in the center, in that a central control groove (47), which is connected to the center section of the overflow channels (44) and is dedicated for regulating the flooding of the operating chamber (23) is incorporated in the inner wall of one of the housing halves (2, 3), the length dimension of the groove (47) extending over a peripheral angle ($\beta$) of the inner wall in the magnitude of 30-60° and the cross-section thereof essentially corresponds to twice the cross-section of one of the overflow channels (44).

11. The rotary-piston engine according to claim 10, embodied as an externally-supplied ignition engine with a throttle organ (48), an injection valve (50) for injecting the fuel, and with at least one sparkplug (51), characterized in that the throttle organ (48) is assigned to the center section of the overflow channels (44), that the injection valve (50) is mounted in wall section of the housing (1) defining the control groove (47) and directed against the respectively opening operating chambers (23), and that the at least one sparkplug (51) is located in the center of the wall section of the housing (1) surrounding the pivoting region of the pistons (13-16), the sparkplug (51) being displaced from the upper dead center (OT) opposite to the rotational direction of the rotational axis (8) at a pre-ignition angle ($\mu$), from which equal burning distances result in or opposite to the rotational direction in the operating chambers (23), when the engine is at maximum output.

12. The rotary-piston engine according to claim 11, characterized in that each of the pistons (13-16; 29, 30) are embodied with a bag-shaped recess (54; 55), forming a swirl chamber and being arranged in an end section of their operating surface (21), the end section being close to the housing, whereby each of the recesses (54) of the pistons (13-16) of the externally-supplied ignition engine are embodied with a base surface (52) extending at least approximately radially relative to the pivoting axis (9), or each of the recesses (55) of the pistons (29, 30) of the self-ignition engine are embodied with one base surface (57) converging towards the end of the operating surface (21) located close to the housing.

13. The rotary-piston engine according to claim 10, embodied as self-ignition engine with at least one injection nozzle for injecting the fuel, characterized in that the at least one injection nozzle is mounted in the center of the wall section of the housing (1) surrounding the pivoting region of the pistons (13-16; 29, 30), the injection nozzle being displaced from the upper dead center (OT) opposite to the rotational direction of the rotational axis (8) at a pre-ignition angle ($\mu$), from which equal burning distances result in or opposite to the rotational direction in the operating chambers (23), when the engine is at maximum output.

14. The rotary-piston engine according to claim 13, characterized in that each of the pistons (13-16; 29, 30) are embodied with a bag-shaped recess (54; 55), forming a swirl chamber and being arranged in an end section of their operating surface (21), the end section being close to the housing, whereby each of the recesses (54) of the pistons (13-16) of the externally-supplied ignition engine are embodied with a base surface (52) extending at least approximately radially relative to the pivoting axis (9), or each of the recesses (55) of the pistons (29, 30) of the self-ignition engine are embodied with one base surface (57) converging towards the end of the operating surface (21) located close to the housing.

15. A road vehicle with a rotary-piston engine according to claim 1, embodied as a drive motor.

* * * * *

UNITED STATES PATENT AND TRADEMARK OFFICE

CERTIFICATE OF CORRECTION

PATENT NO. : 7,469,673 B2
APPLICATION NO. : 10/599669
DATED : December 30, 2008
INVENTOR(S) : Arnold Wagner It is certified that error appears in the above-identified patent and that said Letters Patent is hereby corrected as shown below:

Column 6, line 32, please insert the word -- As -- before the word "can."

Column 7, line 67, please replace "65" with -- 66 --.

Column 7, line 67, please replace "66" with -- 86 --.

Signed and Sealed this

Seventeenth Day of March, 2009

JOHN DOLL
*Acting Director of the United States Patent and Trademark Office*